US008764077B2

(12) United States Patent
Takagi et al.

(10) Patent No.: US 8,764,077 B2
(45) Date of Patent: Jul. 1, 2014

(54) VEHICLE DOOR LOCK DEVICE

(75) Inventors: Masaharu Takagi, Nagoya (JP); Satoshi Yamaji, Nagoya (JP)

(73) Assignee: Ansei Corporation, Obu-Shi (JP)

( * ) Notice: Subject to any disclaimer, the term of this patent is extended or adjusted under 35 U.S.C. 154(b) by 175 days.

(21) Appl. No.: 13/386,353

(22) PCT Filed: Jul. 7, 2010

(86) PCT No.: PCT/JP2010/061517
§ 371 (c)(1),
(2), (4) Date: Jan. 20, 2012

(87) PCT Pub. No.: WO2011/010554
PCT Pub. Date: Jan. 27, 2011

(65) Prior Publication Data

US 2012/0110920 A1 May 10, 2012

(30) Foreign Application Priority Data

Jul. 22, 2009 (JP) ..... 2009-170659

(51) Int. Cl.
*E05B 3/00* (2006.01)

(52) U.S. Cl.
USPC ..... 292/336.3

(58) Field of Classification Search
CPC ..... E05B 81/14; E05B 85/26
USPC ..... 292/201, 216, DIG. 23, 336.3
See application file for complete search history.

(56) References Cited

U.S. PATENT DOCUMENTS 2,864,641 A * 12/1958 Leslie ..... 292/336.3
3,799,596 A * 3/1974 Nozomu et al. ..... 292/216
4,536,021 A * 8/1985 Mochida ..... 292/201

(Continued)

FOREIGN PATENT DOCUMENTS

CN 1122870 5/1996
EP 1 375 794 1/2004

(Continued)

OTHER PUBLICATIONS

International Preliminary Examination Report from parent application No. PCT/JP2010/061517.

(Continued)

*Primary Examiner* — Kristina Fulton
*Assistant Examiner* — Nathan Cumar
(74) *Attorney, Agent, or Firm* — J-TEK Law PLLC; Jeffrey D. Tekanic; Scott T. Wakeman

(57) ABSTRACT

A switching lever of a vehicle door lock device includes a lever main body, an inertial lever having a mass body pivotably disposed on the lever main body so as to be pivotable from its initial position about a pivot, and a torsion coil spring disposed between the lever main body and the inertial lever and biasing the inertial lever towards its initial position. If the inertial lever is disposed in its initial position and is displaced integrally with the lever main body, the inertial lever will press a pawl, thereby causing a fork to switch to an unlocked position. However, if an inertial force greater than a predetermined value acts on the mass body, the inertial lever will pivot from its initial position in a direction opposite of the interial force and avoid pressing the pawl, such that the fork is maintained in a locked state.

19 Claims, 11 Drawing Sheets

(56) References Cited

U.S. PATENT DOCUMENTS

| | | | | |
|---|---|---|---|---|
| 5,769,471 | A * | 6/1998 | Suzuki et al. | 292/336.3 |
| 5,865,481 | A * | 2/1999 | Buschmann | 292/216 |
| 6,698,262 | B2 * | 3/2004 | Wittwer | 70/208 |
| 2003/0234544 | A1 * | 12/2003 | Jankowski et al. | 292/220 |
| 2004/0245786 | A1 | 12/2004 | Hashiba et al. | |
| 2007/0085349 | A1 * | 4/2007 | Merideth et al. | 292/183 |
| 2009/0079208 | A1 | 3/2009 | Mizuno et al. | |

FOREIGN PATENT DOCUMENTS

| | | |
|---|---|---|
| JP | 2005-120764 | 5/2005 |
| JP | 2005146746 | 6/2005 |
| JP | 2009-084994 | 4/2009 |

OTHER PUBLICATIONS

International Search Report from parent application No. PCT/JP2010/061517.

Office Action mailed Sep. 24, 2013 for counterpart Chinese patent application No. 201080032183.5, including English translation thereof.

* cited by examiner

VEHICLE DOOR LOCK DEVICE

CROSS-REFERENCE

This application is the US national stage of International Patent Application No. PCT/JP2010/061517 filed on Jul. 7, 2010, which claims priority to Japanese Patent Application No. 2009-170659, filed on Jul. 22, 2009.

TECHNICAL FIELD

The present invention relates to a vehicle door lock device.

BACKGROUND ART

A prior-art vehicle door lock device is disclosed in Patent Document 1. This vehicle door lock device includes a mounting member, a fork, a pawl and a switching lever.

The mounting member is provided on a door that opens and closes in a vehicle width direction relative to a vehicle body. A striker is fixed to the vehicle body; the mounting member is formed with an entry opening, into which the striker is inserted. A fork is pivotably provided on the mounting member. The fork is switchable between a locking state, in which the striker is locked within the entry opening, and a released state, in which locking of the striker within the entry opening is released. The pawl is pivotably provided on the mounting member. The pawl is capable of fixing or allowing pivoting movement of the fork.

The switching lever presses the pawl to switch the fork from the locking state to the released state. More specifically, the switching lever is supported by the mounting member in such a way as to be movable downward by a door opening operation. One end of each of two coil springs, which face each other, is fixed to the right and left sides, respectively, of the switching lever, and the other end of each coil spring is fixed to the mounting member. An engagement protrusion portion, which protrudes downward, and an engagement hole, which surrounds the engagement protrusion portion in a U shape from below, are formed at the center of the switching lever. In other words, the engagement hole is formed by positioning engagement recess portions on the right and left sides of the engagement protrusion portion to define the U-shape by the two engagement recess portions. The pawl includes a ratchet abutting the fork, a rotation shaft having one of its ends integrally coupled to the ratchet, and an opening lever that is integrally coupled to the other end side of the rotation shaft and is formed with an engagement claw portion. The engagement claw portion of the opening lever is inserted into the engagement hole of the switch lever. Therefore, if the switching lever moves downward while the engagement claw portion is positioned under the engagement protrusion portion, the engagement claw portion will come into contact with the engagement protrusion portion.

In the vehicle door lock device having the above-described structure, the switching lever is, in the normal state, in its initial position when the switching lever is substantially perpendicular to the vehicle width direction. In this state, if the switching lever moves downward due to a door opening operation, the engagement protrusion portion of the switching lever presses the engagement claw portion of the opening lever. As a result, the pawl pivots about the rotation shaft, the ratchet moves away from the fork, and the fork is thereby switched from the locking state to the released state.

Furthermore, in this vehicle door lock device, if the door or the vehicle body experiences an impact from the outside of the vehicle due to a side collision or the like, an inertial force will act on the switching lever with respect to the direction of the impact. In this case, the switching lever will compress one of the coil springs and expand the other coil spring to pivot towards the opposite direction of the direction of the impact. As a result, the switching lever will change from a state, in which the engagement protrusion portion is positioned above the engagement claw portion, to a state, in which the engagement claw portion is positioned in the engagement recess portions. In this state, even if a door opening operation is caused by the impact and the switching lever moves downward, the engagement claw portion will not come into contact with the engagement protrusion portion, but instead will be merely displaced within the engagement recess portions. In other words, even if the switching lever moves downward unintentionally, what results is a so-called "swing-and-miss state" in which the engagement claw portion is not pressed, i.e. the fork is not switched from the locking state to the released state. In this way, the prior-art vehicle door lock device prevents an unintended opening of the door at the time of the impact to thereby ensure the safety of the occupants. A similar vehicle door lock device is disclosed in Patent Document 2.

CITATION LIST

Patent Literature

Patent Document 1: Japanese Patent Application Laid-Open No. 2005-120764
Patent Document 2: EP 1 375 794 A2

SUMMARY OF THE INVENTION

However, it would be desirable to improve the above-described prior-art vehicle door lock device, in order to more robustly prevent the door from opening due to an impact.

In this respect, in the above-described prior-art vehicle door lock device, the engagement claw portion of the open lever is inserted in the engagement hole of the switching lever; therefore, the angle, through which the switch lever pivots, is limited by the engagement hole and the engagement claw portion. Furthermore, because the coil springs are provided between the switching lever and the mounting member, the pivot angle of the switching lever is also limited by the coil springs. For these reasons, it is difficult to increase the pivot angle of the switching lever in the prior-art vehicle door lock device. Therefore, if the switching lever experiences an excessively large impact and tries to pivot wider than the pivot angle, the engagement claw portion will collide with a side wall of the engagement hole and cause the switch lever to bounce and pivot back towards the opposite direction; consequently, it may be impossible to achieve the "swing-and-miss state". In this case, it is difficult for the prior-art vehicle door lock device to reliably prevent the door from opening due to the impact.

The present invention has been made in view of the above-described circumstances of prior art and an object of the invention is to provide a vehicle door lock device capable of more reliably preventing the door from opening due to an impact and to be capable of achieving higher occupant safety.

In one aspect of the present teachings, a vehicle door lock device preferably includes:

a mounting member provided on a door that opens and closes in a vehicle width direction relative to a vehicle body and formed with an entry opening, into which a striker fixed to the vehicle body is inserted;

a fork pivotably provided on the mounting member and configured to be switchable between a locking state, in which the striker is locked within the entry opening, and a released state, in which locking of the striker within the entry opening is released;

a pawl pivotably provided on the mounting member and capable of fixing or allowing pivoting of the fork; and a switching lever that presses the pawl and switches the fork from the locking state to the released state;

wherein the switching lever includes a lever main body, which is configured to be displaced by an opening operation of an exterior door handle or an interior door handle, an inertial lever, which is provided on the lever main body so as to be pivotable from its initial position to one side and/or the other side about a pivot extending in a direction orthogonal to the vehicle width direction and which is capable of pressing the pawl if the inertial lever in the initial position is displaced integrally with the lever main body, and a biasing member having a biasing force that retains the inertial lever in the initial position, wherein the biasing member is a torsion coil spring provided coaxially with the pivot between the lever main body and the inertial lever, and the inertial lever has a mass body, wherein the biasing member and the mass body are set such that if an inertial force greater than a pre-determined value acts on the mass body, the inertial lever pivots from the initial position about the pivot relative to the lever main body and avoids pressing the pawl, and wherein the inertial lever is configured such that when the inertial lever pivots from the initial position due to the inertial force, its pivot angle is not limited by the lever main body.

In the vehicle door lock device according to this aspect of the present teachings, the switching lever includes the lever main body, the inertial lever and the biasing member. In the normal state, the inertial lever is displaceable integrally with the lever main body while being retained in the initial position by the biasing force of the biasing member. Therefore, if the lever main body is displaced by a door opening operation in the normal state, the inertial lever presses the pawl and the fork is switched from the locking state to the released state.

In addition, in this vehicle door lock device, the inertial lever includes the mass body. When an inertial force greater than the pre-determined value acts on the mass body, the inertial lever is caused to pivot from the initial position to one side and/or the other side about the pivot relative to the lever main body. In other words, if the door or the vehicle body experiences an impact in the vehicle width direction from the outside of the vehicle due to a side collision or the like, the inertial force in the opposite direction to the direction of the impact acts on the mass body of the inertial lever. In this case, the inertial lever pivots against the biasing force of the biasing member from the initial position towards the opposite direction of the impact direction about the pivot extending in the direction orthogonal to the vehicle width direction. Therefore, even if the lever main body is displaced unintentionally, the inertial lever will not displace integrally with the lever main body and will avoid pressing the pawl. As a result, the so-called "swing-and-miss state", in which the fork is not switched from the locking state to the released state, is achieved. Therefore, the door will not open unintentionally at the time of the impact and the safety of the occupant(s) is ensured.

Moreover, in this vehicle door lock device, the inertial lever is configured such that its pivot angle is not limited by the lever main body when the inertial lever pivots from the initial position due to the inertial force. In other words, unlike the prior art, the lever main body is not provided with an engagement hole and the pivot angle of the inertial lever is not limited by the engagement hole. Moreover, in this vehicle door lock device, because the biasing member is a torsion coil spring provided coaxially with the pivot between the lever main body and the inertial lever, the pivot angle of the inertial lever is less likely to be limited by the biasing member as compared to the above-described prior art. As a result, it is easy to increase the pivot angle of the inertial lever in this vehicle door lock device. Therefore, even if an excessively large impact is experienced, the inertial lever can adapt to the impact and pivot to a sufficient angle. As a result, as compared to the above-described prior art, the problem, in which the inertial lever, which pivots due to the impact, cannot sufficiently pivot and bounces back, is less likely to occur. Therefore, this vehicle door lock device is capable of reliably achieving the "swing-and-miss state".

Consequently, such a vehicle door lock device is capable of reliably preventing the door from opening due to the impact and achieving higher occupant safety.

Moreover, because the biasing member is a torsion coil spring provided coaxially with the pivot, this vehicle door lock device is easy to miniaturize and exhibits excellent mountability on the vehicle.

The pivot extends in the direction orthogonal to the vehicle width direction relative to the lever main body. For example, the pivot may extend in a front-rear direction or in an up-down direction. The inertial lever may be pivotable only to one side or only to the other side, or to the one side and to the other side from the initial position. If the vehicle door lock device is intended to be mounted on the door on the left side of the vehicle body, the inertial lever needs to be pivotable only to the left side from the initial position or to the right and left sides from the initial position. If the vehicle door lock device is intended to be mounted on the door on the right side of the vehicle body, the inertial lever needs to be pivotable only to the right side from the initial position or to the right and left sides from the initial position.

In a vehicle door lock device according to a preferred embodiment, the pivot angle of the inertial lever from the initial position may be limited, for example, by a restricting surface formed on the mounting member or on the housing. In such a case, the inventors have experimentally found that the "swing-and-miss state" can be achieved more reliably by providing a pivot angle of the inertial lever that is equal to or greater than 45° from the initial position. In the above-described prior art, it is difficult to provide a pivot angle of the switching lever that is equal to or greater than 45° from the initial position due to structural constraints. In the present embodiment, on the other hand, it is easy to provide a pivot angle equal to or greater than 45° from the initial position by using of the above-described structure.

In a vehicle door lock device according to another preferred embodiment, it is preferable that the lever main body is made of resin and the inertial lever is made of metal. In this case, it is possible to reduce the weight of the lever main body. It is also possible to provide mass to the inertial lever while miniaturizing it. In this way, further miniaturization and weight savings of the vehicle door lock device can be realized, and the ability to mount it on the vehicle can be further enhanced thereby. Furthermore, if the inertial lever is made of metal, the strength of the inertial lever can be also increased.

In a vehicle door lock device according to another preferred embodiment, it is preferable that the inertial lever is die-cast. In this case, because a thick-walled inertial lever having a large mass can be easily obtained, a reduction of the manufacturing costs can be realized. In particular, it is more preferable to employ a zinc alloy die-casting material as the material of the inertial lever from the viewpoints of specific gravity and material cost.

EMBODIMENTS FOR CARRYING OUT THE INVENTION

An embodiment that embodies the present invention will be described below with reference to the drawings.

Embodiment

Figure 1:
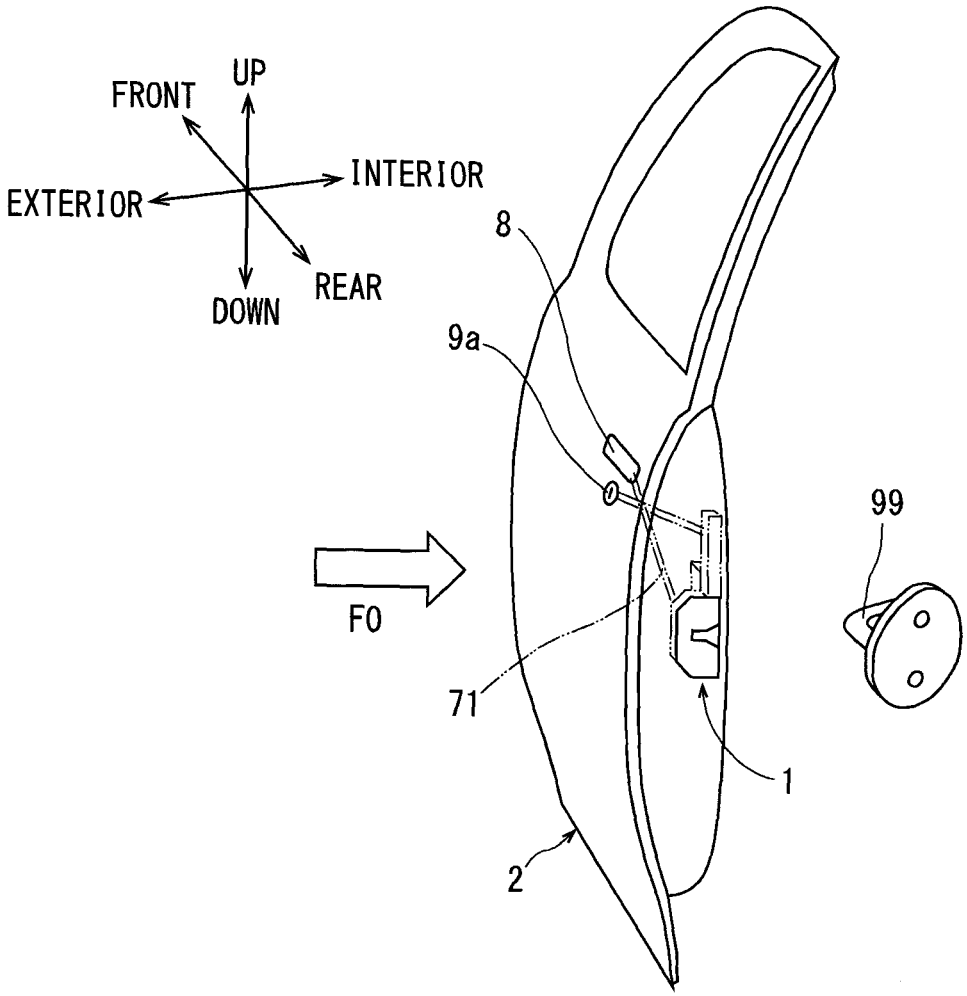
FIG. 1 is a perspective view of a door having a vehicle door lock device attached thereto in an embodiment.

As shown in FIG. 1, a vehicle door lock device 1 (hereafter simply referred to as "door lock device 1") can be applied in an embodiment to a vehicle, such as an automobile, a bus, an industrial vehicle, etc. The door lock device 1 is disposed, in an orientation that corresponds to the front-rear, up-down, interior-exterior directions of the vehicle as shown in FIGS. 2 and 3, on a rearward end side of a vehicle door 2 that opens and closes in a hinged manner.

Figure 2:
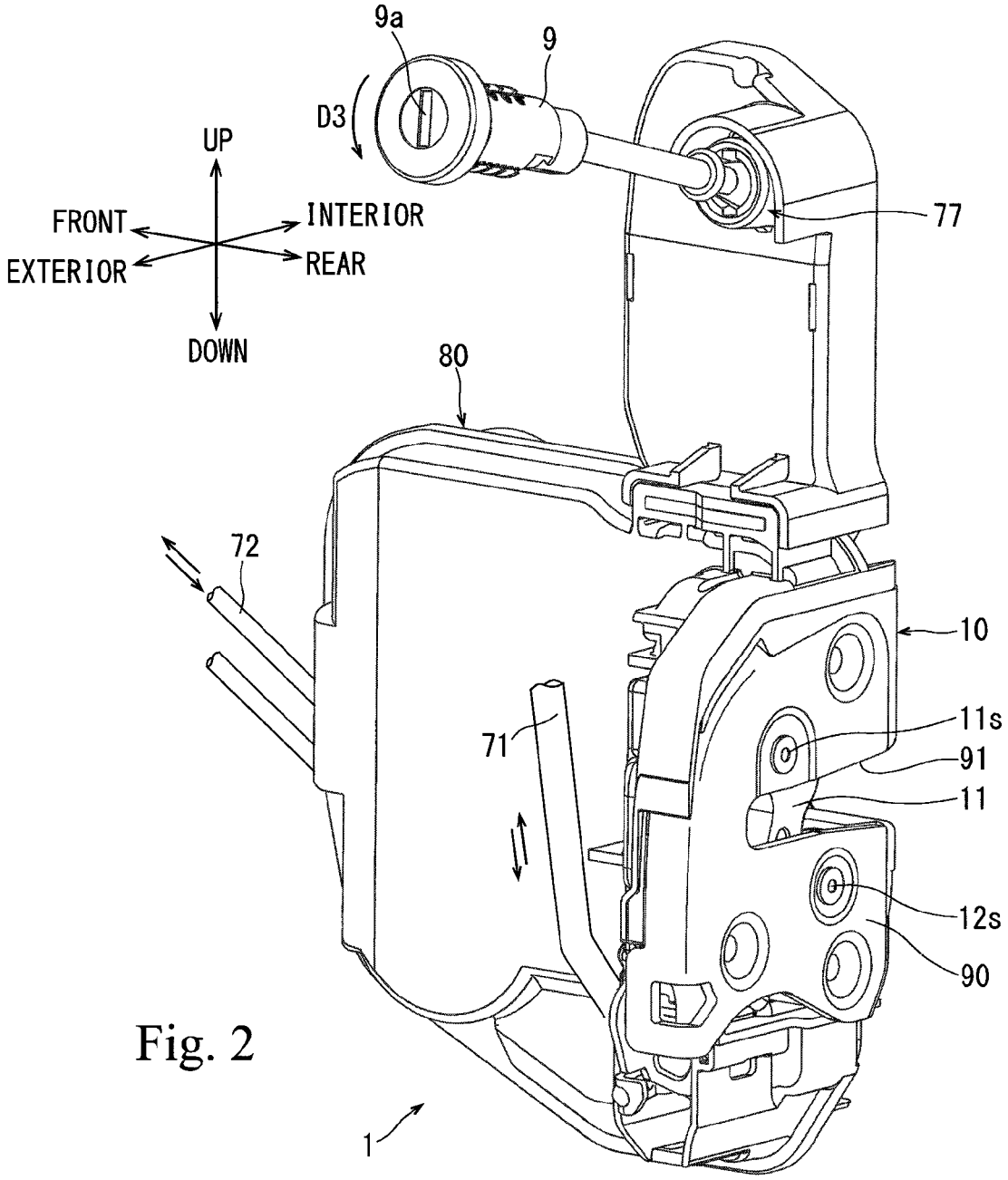
FIG. 2 is a perspective view of the vehicle door lock device in the embodiment.
Figure 3:
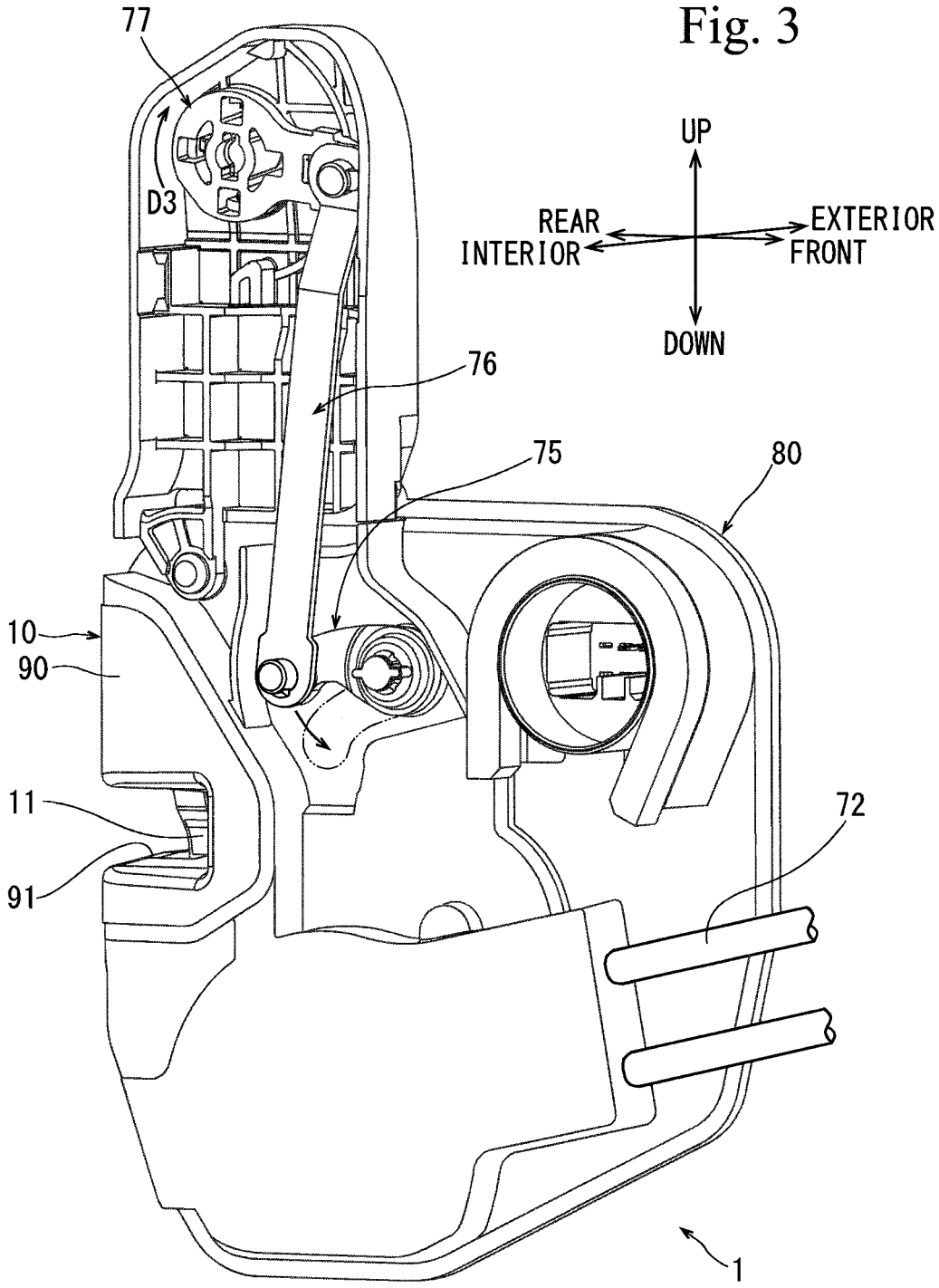
FIG. 3 is a perspective view of the vehicle door lock device in the embodiment.

As shown in FIGS. 1 and 2, a key cylinder 9 is disposed such that a key insertion hole 9*a* is exposed on an exterior surface of a rear portion of the door 2. Inside the door 2, the door lock device 1 is disposed below the key cylinder 9. An entry opening 91 of the door lock device 1 is exposed on the rearward end of the door 2 as will be described below in detail. When the door 2 is closed, a striker 99 (shown in FIGS. 1 and 6 to 12) fixed to a vehicle body is inserted into the entry opening 91. All of the front-rear, up-down, interior-exterior directions shown in FIGS. 2 to 11 correspond to those in FIG. 1. Although a door lock device 1 provided on a left door is shown in the embodiment as an example, the door lock device 1 will simply be a mirror image if it is provided on a right door. Moreover, the door lock device 1 can also be provided on a front end side of a vehicle door (not shown) that opens and closes in a sliding manner.

The configuration of the door lock device 1 will be described below in detail. As shown in FIGS. 2 and 3, the door lock device 1 is formed by mounting component members, such as a lock mechanism 10, on a main housing 80 disposed inside the rearward end side of the door 2. A rod 71 (shown in FIGS. 2, 6, and 8 to 11), which transmits the movement of an exterior door handle 8 (shown in FIG. 1) provided on the exterior side of the door 2, and a cable 72 (shown in FIGS. 2, 3, and 7), which transmits the movement of a known interior door handle (not shown) provided on the interior side of the door 2, are connected to the main housing 80, which is mounted on the door 2. As shown in FIG. 3, an outer locking lever 75 is pivotably provided on the surface of the main housing 80 that faces the interior of the vehicle. A rotor 77 and a linkage 76, which transmit a locking movement (a turning movement in direction D3 shown in FIGS. 2 and 3) of the key cylinder 9, are linked to the outer locking lever 75.

The lock mechanism 10 switches between a state, in which the door 2 is locked (hereafter simply referred to as "locked state"), and a state, in which locking of the door 2 is released (hereafter simply referred to as "released state"). The lock mechanism 10 includes a switching lever 13, a transmission mechanism, a mounting member 90, a fork 11 and a pawl 12 as shown in FIGS. 4 and 5.

Figure 4:
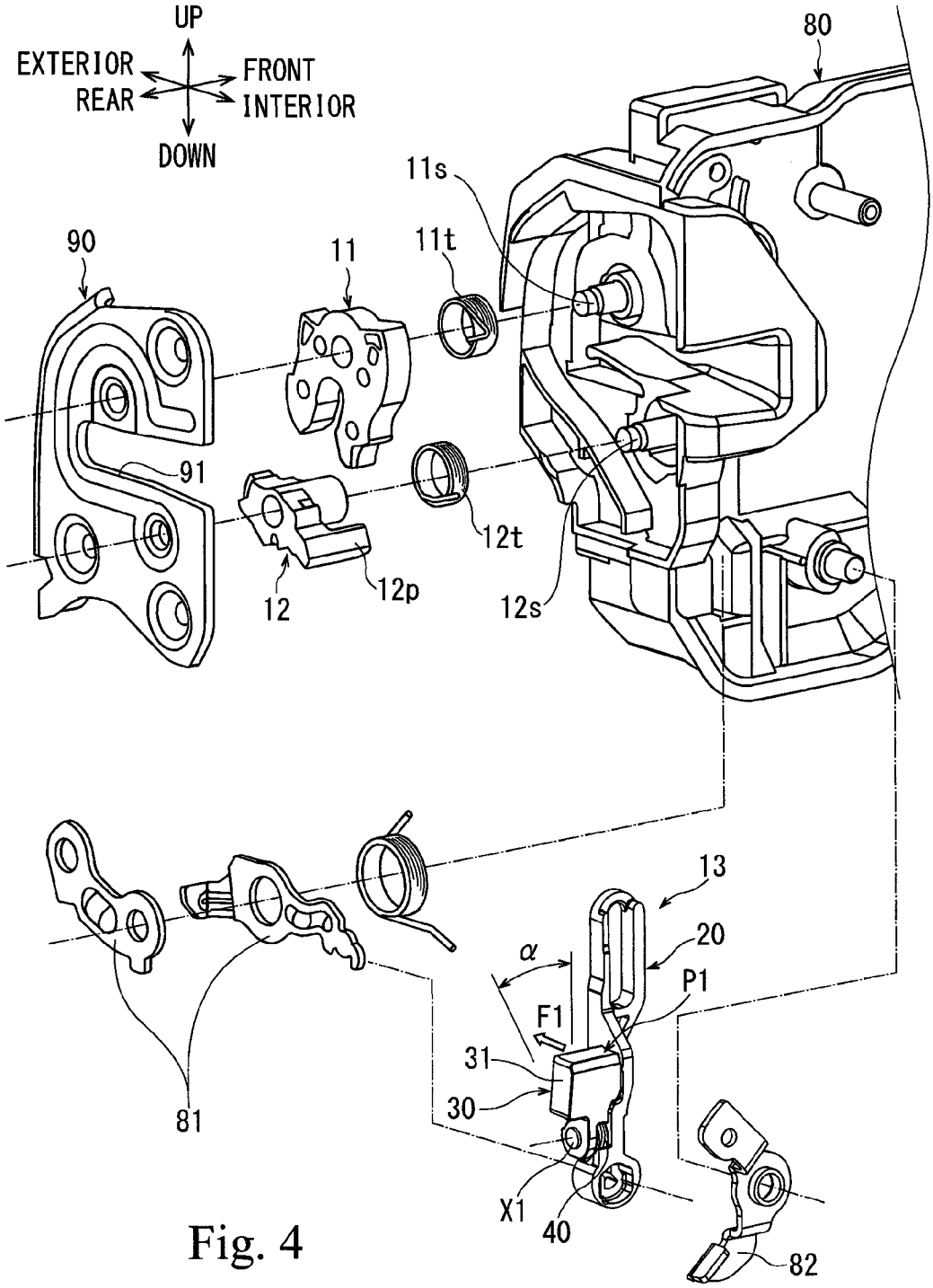
FIG. 4 is an exploded perspective view of the vehicle door lock device in the embodiment, which depicts a mounting member, a fork, a pawl, a switching lever, opening levers, etc.
Figure 5:
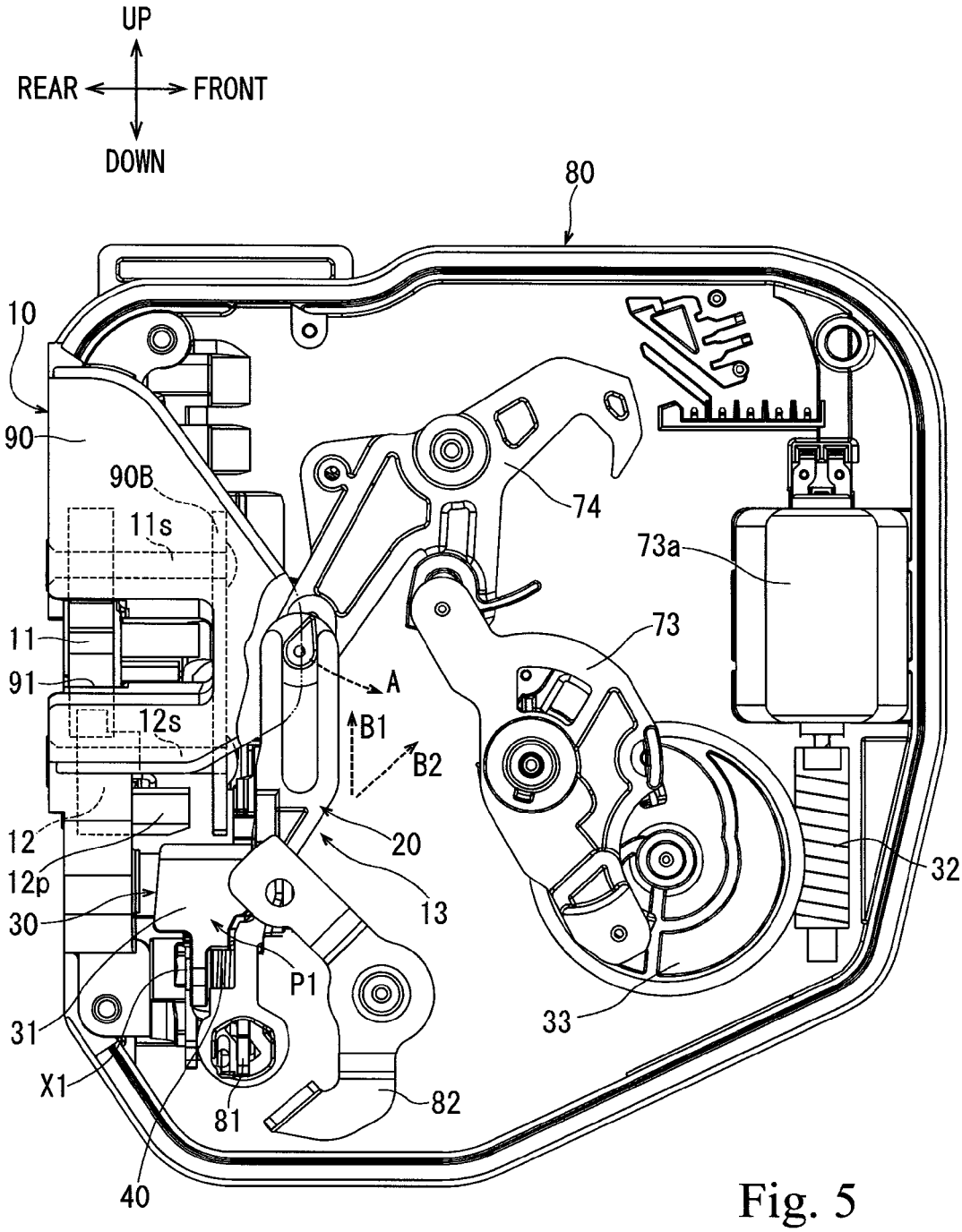
FIG. 5 is a side view of the vehicle door lock device in the embodiment with a portion of a housing detached, which depicts the mounting member, the fork, the pawl, the switching lever, the opening levers, a locking lever, etc.

As shown in FIG. 4, the switching lever 13 includes a resin lever main body 20, a zinc alloy die-cast inertial lever 30 and a torsion coil spring 40 serving as a biasing member.

The lever main body 20 has an elongated shape extending in the up-down direction and is configured to be displaced upward when pushed up by opening levers 81, 82, which will be described later (see FIGS. 5 to 7). A circular cylindrical pivot X1 extending in the front-rear direction orthogonal to the vehicle width direction is formed so as to project from a lower portion of the lever main body 20.

The inertial lever 30 is pivotably supported on the pivot X1. The inertial lever 30 integrally includes a block-shaped mass body 31 projecting upward relative to the pivot X1. Between the lever main body 20 and the inertial lever 30, the torsion coil spring 40 is arranged coaxially with the pivot X1.

The torsion coil spring 40 biases the inertial lever 30 so that the inertial lever 30 pivots about the pivot X1 toward the interior side of the vehicle body. On the other hand, the lever main body 20 has a stopper (not shown) that restricts the inertial lever 30 so that the inertial lever 30 does not pivot toward the interior side of the vehicle body farther than the initial position P1 shown in FIG. 4. With this configuration, the torsion coil spring 40 retains the inertial lever 30 in the initial position P1 in the normal state (the state in which the impact F0 shown in FIG. 1 is not acting). In this case, if the lever main body 20 is displaced upward, the inertial lever 30 is displaced integrally with the lever main body 20.

The biasing force of the torsion coil spring 40 and the mass of the mass body 31 are set so that the inertial lever 30 pivots about the pivot X1 from the initial position P1 toward the exterior side of the vehicle body relative to the lever main body 20 when an inertial force F1 greater than a pre-determined value acts on the mass body 31. At this time, the pivot angle α of the inertial lever 30 is not restricted by the lever main body 20, but rather is restricted by a restricting surface (not shown) formed at an angle of 45° or greater on an inner wall surface of the main housing 80. With this configuration in this embodiment, it is possible to easily implement a pivot angle α of the inertial lever 30 that is 45° or greater.

Figure 6:
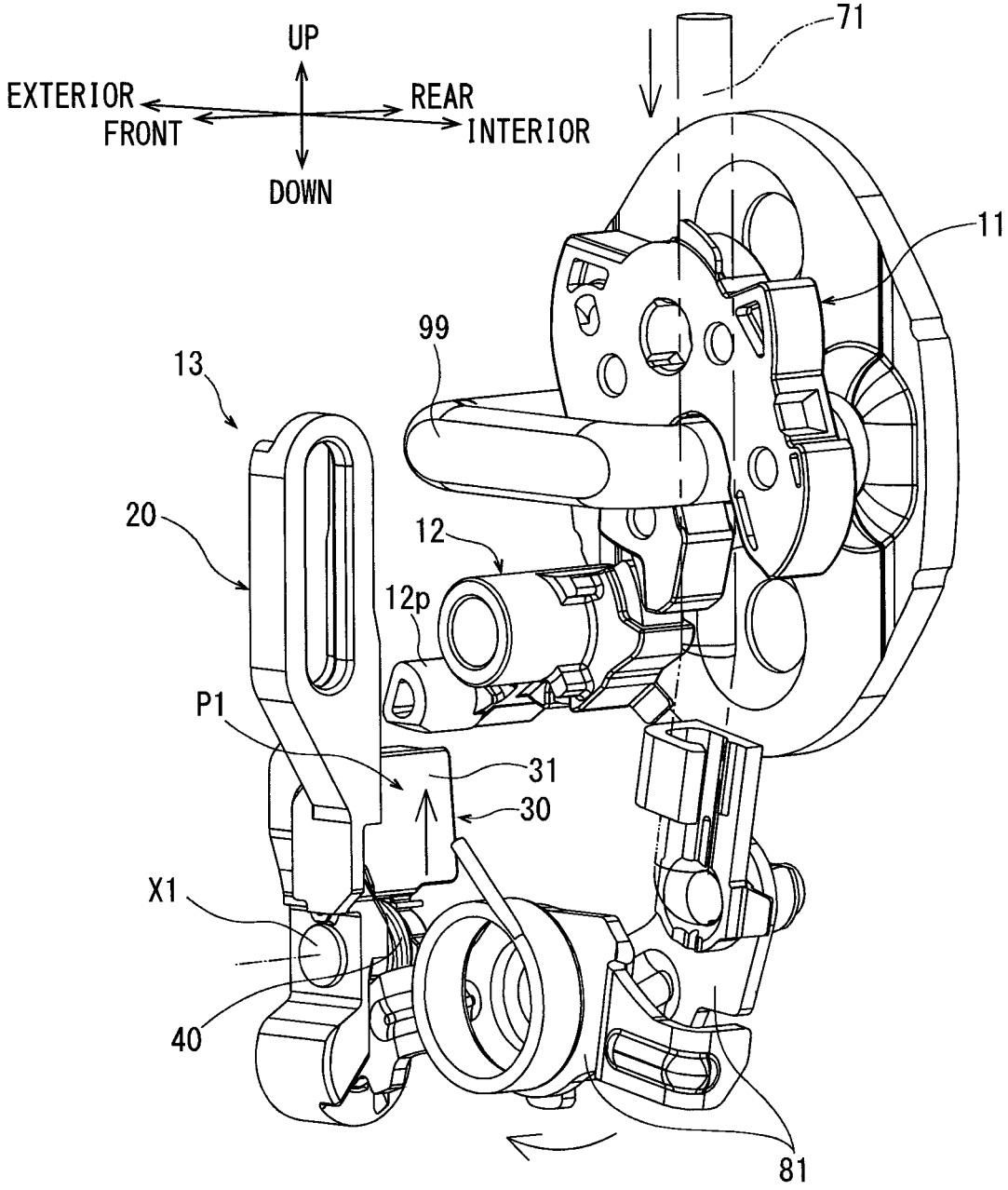
FIG. 6 is a partially enlarged perspective view of the vehicle door lock device in the embodiment, which depicts in an extracted manner a striker, the fork, the pawl, the switching lever and an opening lever (connected to an exterior door handle).
Figure 7:
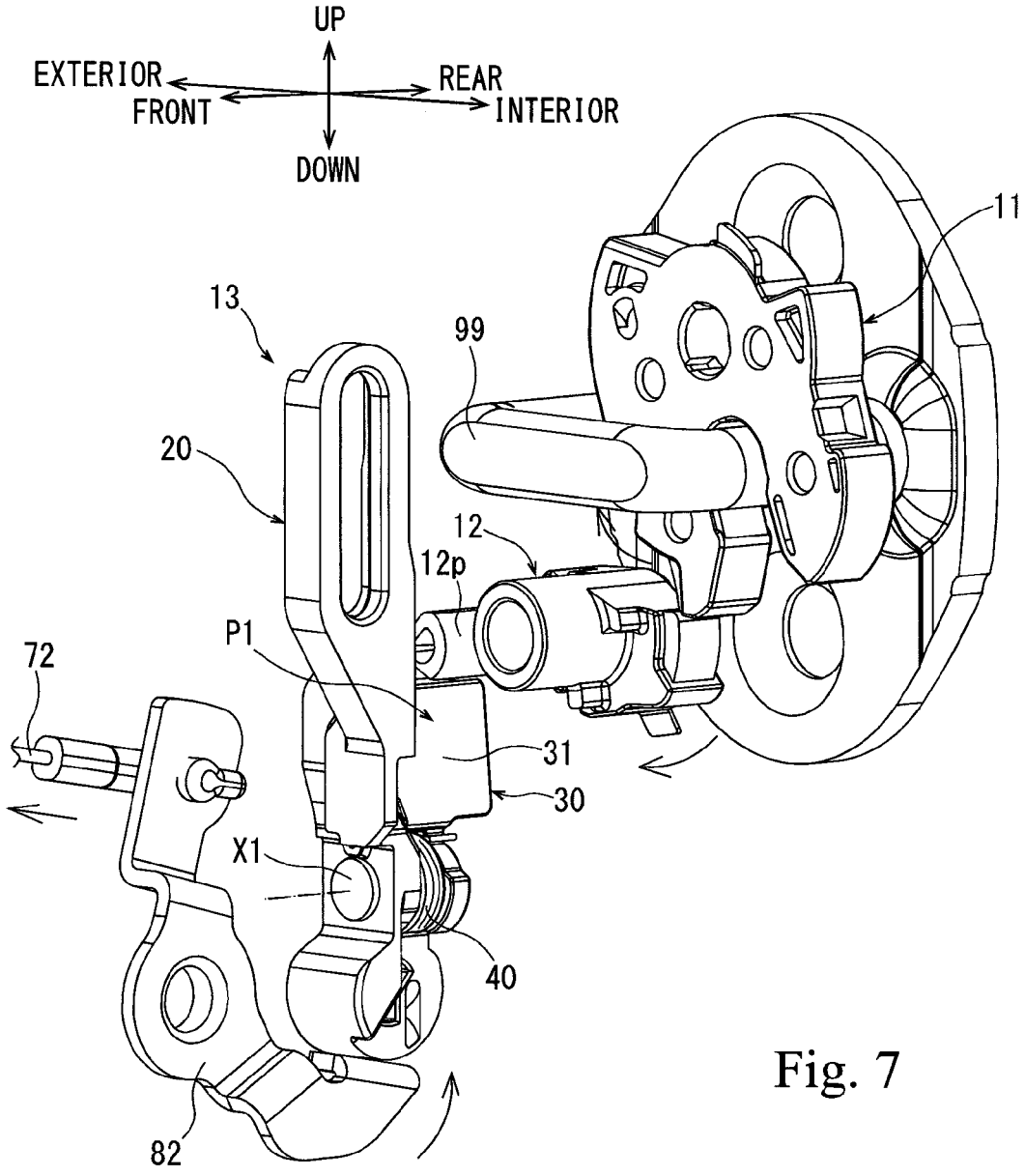
FIG. 7 is a partially enlarged perspective view of the vehicle door lock device in the embodiment, which depicts in an extracted manner the striker, the fork, the pawl, the switching lever and an opening lever (connected to an interior door handle).

As shown in FIGS. 4 to 7, the transmission mechanism transmits movements of the rod 71 and the cable 72 to the switching lever 13 and displaces the lever main body 20 upward. The transmission mechanism includes opening levers 81, 82, inner locking levers 74, 73, etc. For example, if the occupant operates the exterior door handle 8 and displaces the rod 71 downward as shown in FIG. 6, the opening lever 81 linked to the rod 71 pivots and displaces the lever main body 20 upward within the main housing 80. On the other hand, if the occupant operates the interior door handle (not shown) and displaces the cable 72 forward as shown in FIG. 7, the opening lever 82 pivots and displaces the lever main body 20 upward within the main housing 80. In the normal state, if the lever main body 20 is displaced upward, the inertial lever 30 pushes up a contact portion 12*p* of the pawl 12, which will be described later, to pivot the pawl 12 about a pivot shaft 12*s* as shown in FIGS. 6 and 7.

If the occupant turns the key cylinder 9 in the direction of D3 as shown in FIG. 2, the outer locking lever 75 will pivot downward due to the rotor 77 and the linkage 76 as shown in FIG. 3. Then, as shown in FIG. 5, the inner locking lever 74 will pivot in direction A and change the path, along which the lever main body 20 is displaced within the main housing 80, from an up-down direction B1 to a diagonal direction B2. In this case, even if the lever main body 20 is displaced by the rod 71 or the cable 72, the inertial lever 30 will not come into contact with the contact portion 12*p* of the pawl 12, i.e. it is in the locked state, in which the door 2 will not open even if the exterior door handle 8 is operated. Furthermore, in case the occupant performs a centralized door lock operation by driving the motor 73*a* shown in FIG. 5, the inner lock lever 74 will pivot due to the worm gear 32, the worm wheel 33 and the inner locking lever 73 and will change the path, along which the lever main body 20 is displaced, from the up-down direction B1 to the diagonal direction B2.

As shown in FIG. 4, the mounting member 90 is a stamped steel plate; by fastening it to the rearward end of the door 2, the door lock device 1 is fixed to the door 2. The mounting member 90 is formed with the entry opening 91 that has been cut out in a deep groove shape from the interior side toward the exterior side of the vehicle.

Figure 8:
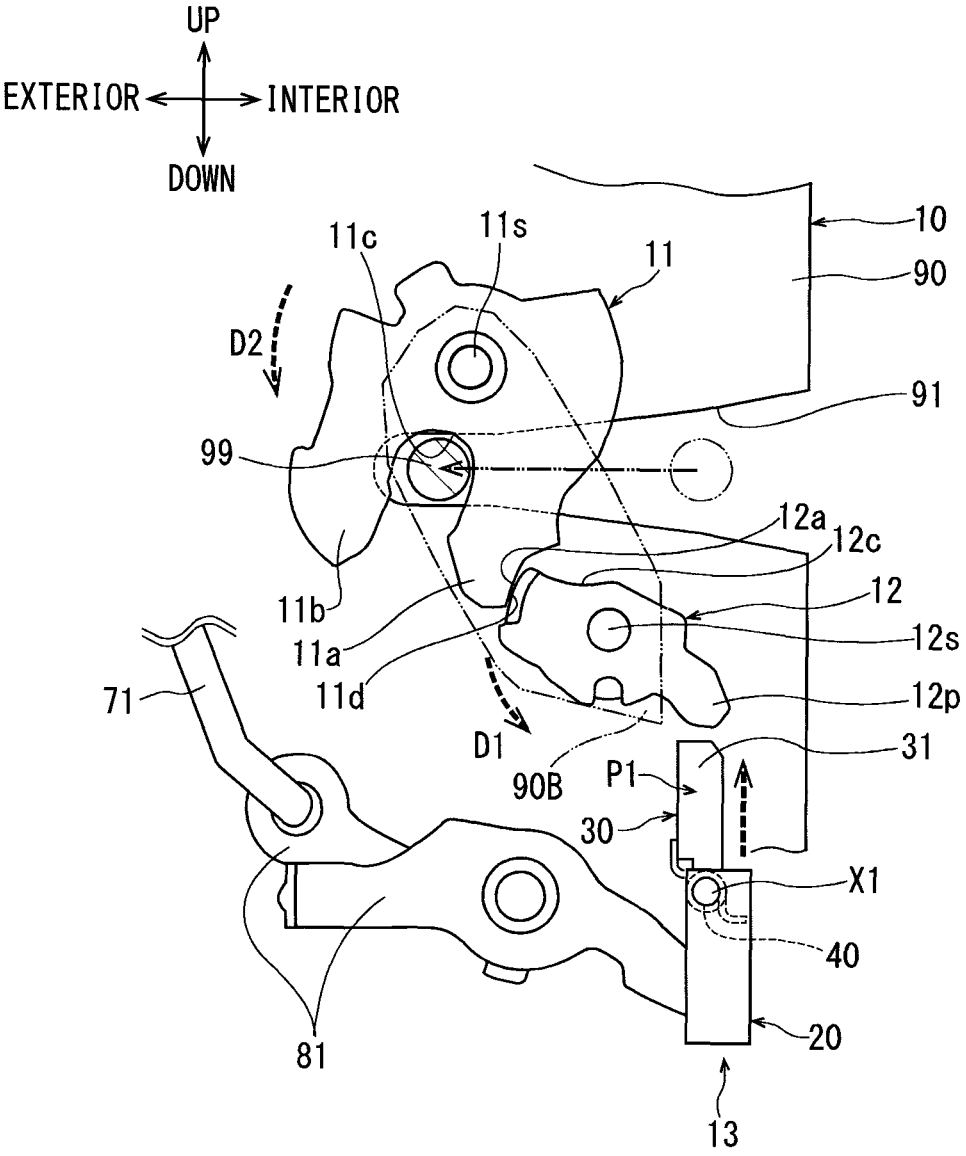
FIG. 8 is a schematic diagram of the vehicle door lock device in the embodiment, which explains operational movements of the fork and the pawl in a locked state.

As shown in FIG. 8, when the door lock device 1 moves accompanying the opening or closing of the door 2, the substantially U-shaped striker 99 enters into the entry opening 91 in a facing manner. Furthermore, the fork 11 and the pawl 12 are provided on the mounting member 90 so as to sandwich the entry opening 91 from above and below.

The fork 11 is pivotably supported on a fork pivot shaft 11*s* disposed above the entry opening 91. The fork 11 is biased by a coil spring 11*t* (shown in FIG. 4) so as to be pivotable about the fork pivot shaft 11*s* in direction D2.

An inner convex portion 11*a* and an outer convex portion 11*b* are formed on the fork 11. In addition, the striker 99 inserted into the entry opening 91 is accommodated in a concave portion 11*c* formed between the inner convex portion 11*a* and the outer convex portion 11*b*. In the state shown in FIG. 8, the fork 11 retains the striker 99 at a bottom portion of the entry opening 91. A latch surface 11*d*, which is contactable with a below-described stopper face 12*a*, is formed at a tip end of the inner convex portion 11*a* that faces the pawl 12.

The pawl 12 is pivotably supported on the pawl pivot shaft 12*s* disposed below the entry opening 91. The pawl 12 is biased by a coil spring 12*t* (shown in FIG. 4) to pivot about the pawl pivot shaft 12*s* in direction D1 and is normally maintained in the orientation shown in FIG. 8. Tip ends of the pawl pivot shaft 12*s* and the fork pivot shaft 11*s* are fixed by a back plate 90B (shown in FIGS. 5 and 8 to 11), which has a flat plate shape and is positioned on the front side of the mounting member 90.

The stopper surface 12*a* is formed on the pawl 12. The stopper surface 12*a* is a curved surface that curves in a circular arc-shaped manner around the pawl pivot shaft 12*s* as a center and is formed so as to face the above-described latch surface 11*d*. The arc forming the stopper face 12*a* ends on the side towards the fork 11 where a sliding face 12*c* starts to extend towards the pawl pivot shaft 12*s*.

Figure 9:
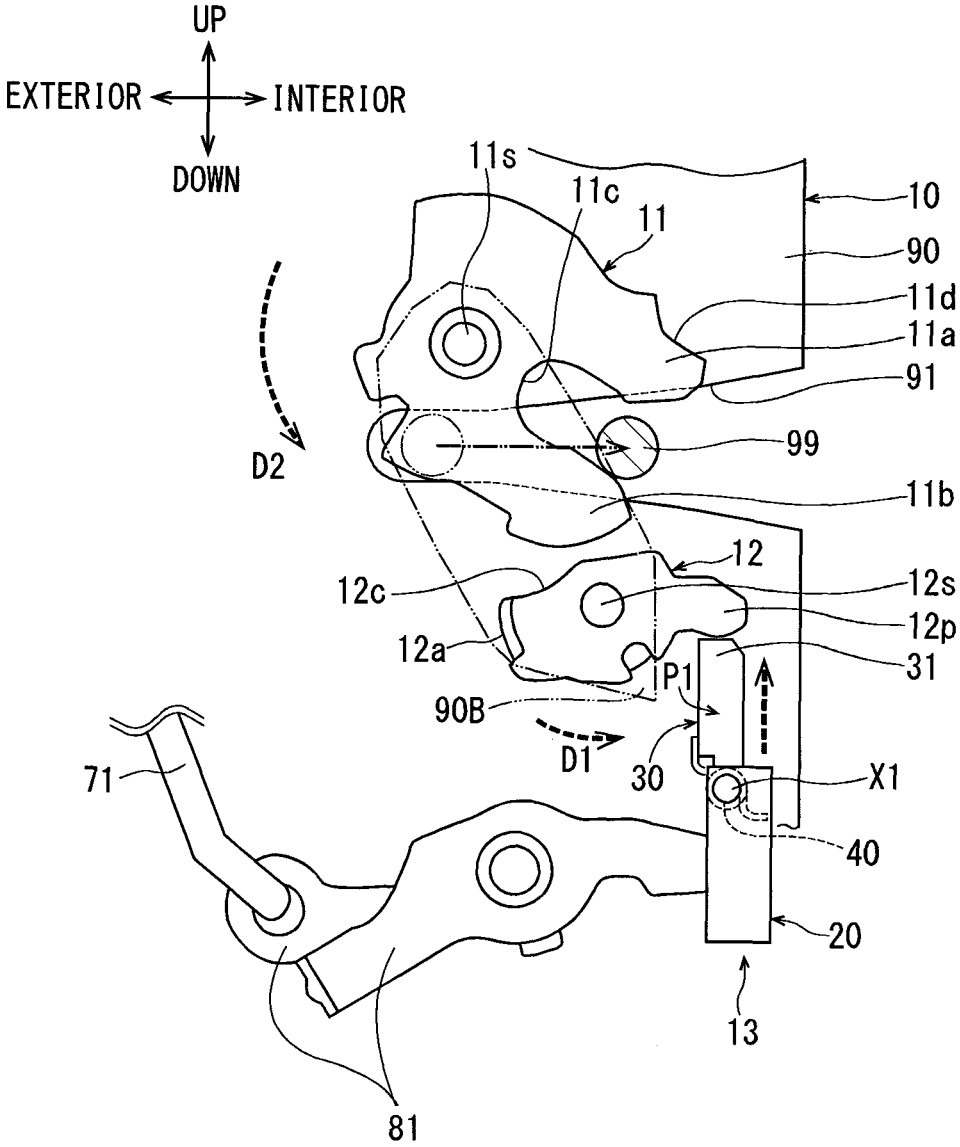
FIG. 9 is a schematic diagram of the vehicle door lock device in the embodiment, which explains operational movements of the fork and the pawl in a released state.

The pawl 12 has a contact portion 12*p* projecting from the side of the pawl pivot shaft 12*s* toward the vehicle interior side. As shown in FIG. 9, if the inertial lever 30, which moves integrally with the lever main body 20, comes into contact with the contact portion 12*p* in the normal state, the pawl 12 is pushed and displaced in direction D1.

As shown in FIG. 8, in the state in which the fork 11 retains the striker 99 at the bottom portion of the entry opening 91, the stopper face 12*a* of the pawl 12 contacts the latch surface 11*d* of the inner convex portion 11*a*. By doing this, the pawl 12 fixes the fork 11 so that the fork 11 will not be pivoted in direction D2. As a result, the lock mechanism 10 brings the door 2 into the locked state.

Then, if the occupant operates the exterior door handle 8 or the interior door handle and the rod 71 or the cable 72 moves, the lever main body 20 is displaced upwardly by the transmission mechanism and the inertial lever 30, which moves integrally with the lever main body 20, comes into contact with the contact portion 12*p* of the pawl 12 as shown in FIG. 9. In this case, the pawl 12 pivots about the pawl pivot shaft 12*s* in direction D1 against the biasing force of the coil spring 12*t*. At this time, the stopper surface 12*a* moves away from the latch surface 11*d* and therefore the pawl 12 allows the fork 11 to pivot. As a result, the fork 11 pivots about the fork pivot shaft 11*s* in direction D2 due to the biasing force of the coil spring 11*t* and displaces the striker 99 in the direction that withdraws the striker 99 from the entry opening 91. As a result, the fork 11 is switched to the state, in which it does not retain the striker 99 in the entry opening 91. As a result, the lock mechanism 10 brings the door 2 into the released state.

If the occupant tries to further open the door 2 in the state shown in FIG. 9, because there is displacement in the direction that further withdraws the striker 99 from the entry opening 91, the fork 11 also further pivots in direction D2 by following the striker 99 and it does not obstruct the occupant's opening operation.

Conversely, in case the striker 99 is inserted within the entry opening 91 when the occupant tries to close the door 2, the fork 11 pivots in the direction opposite to direction D2 by following the striker 99 and returns from the state shown in FIG. 9 to the state shown in FIG. 8. At this time, the tip ends of the outer convex portion 11*b* and the inner convex portion 11*a* slide in such a way that they sequentially come into contact with the sliding face 12*c*. In addition, when the inner convex portion 11*a* moves away from the sliding face 12*c*, the pawl 12 pivots in the direction opposite to direction D1 and returns to the original state shown in FIG. 8. Therefore, the stopper surface 12*a* of the pawl 12 faces the latch surface 11*d* and fixes the pivoting movement of the fork 11. Consequently, the lock mechanism 10 brings the door 2 into the locked state.

Figure 10:
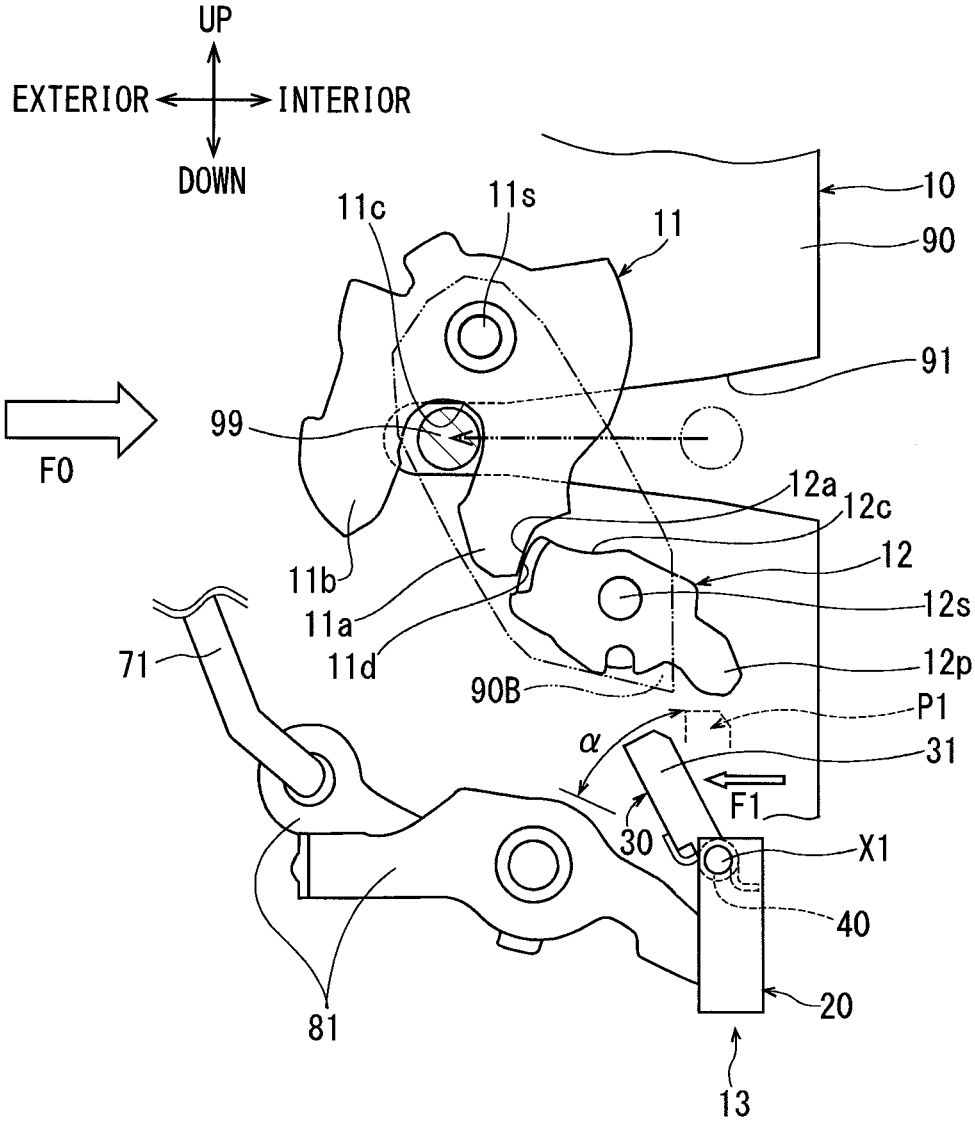
FIG. 10 is a schematic diagram of the vehicle door lock device in the embodiment, which explains movements of a lever main body and an inertial lever when the door and a vehicle body experience an impact from outside of the vehicle.

Further, if the door 2 or the vehicle body experiences an impact F0 from the vehicle exterior due to a side collision or the like as shown in FIG. 1, an inertial force F1 will act on the mass body 31 of the inertial lever 30 in the direction opposite to the impact direction as shown in FIG. 10. In this case, the inertial lever 30 will pivot from the initial position P1 about the pivot X1 against the biasing force of the torsion coil spring 40 in the direction opposite to the impact direction.

Here, the rod 71 is a rigid rod body and is linked to the exterior door handle 8 exposed on the outer surface of the door 2. Therefore, if the door 2 is deformed due to the impact F0 and the relative positional relationship of the outer door handle 8 and the main housing 80 is shortened, the rod 71 will be displaced downward relative to the main housing 80.

In addition, because the external door handle 8 is also a mass body, when the vehicle body experiences the impact F0, the inertial force (not shown) in the direction opposite to the impact direction will also act on the exterior door handle 8. As a result, the outer door handle 8 will move and the rod 71 linked to the exterior door handle 8 will move downward in the same way as when the occupant performs an opening operation of the door 2.

Figure 11:
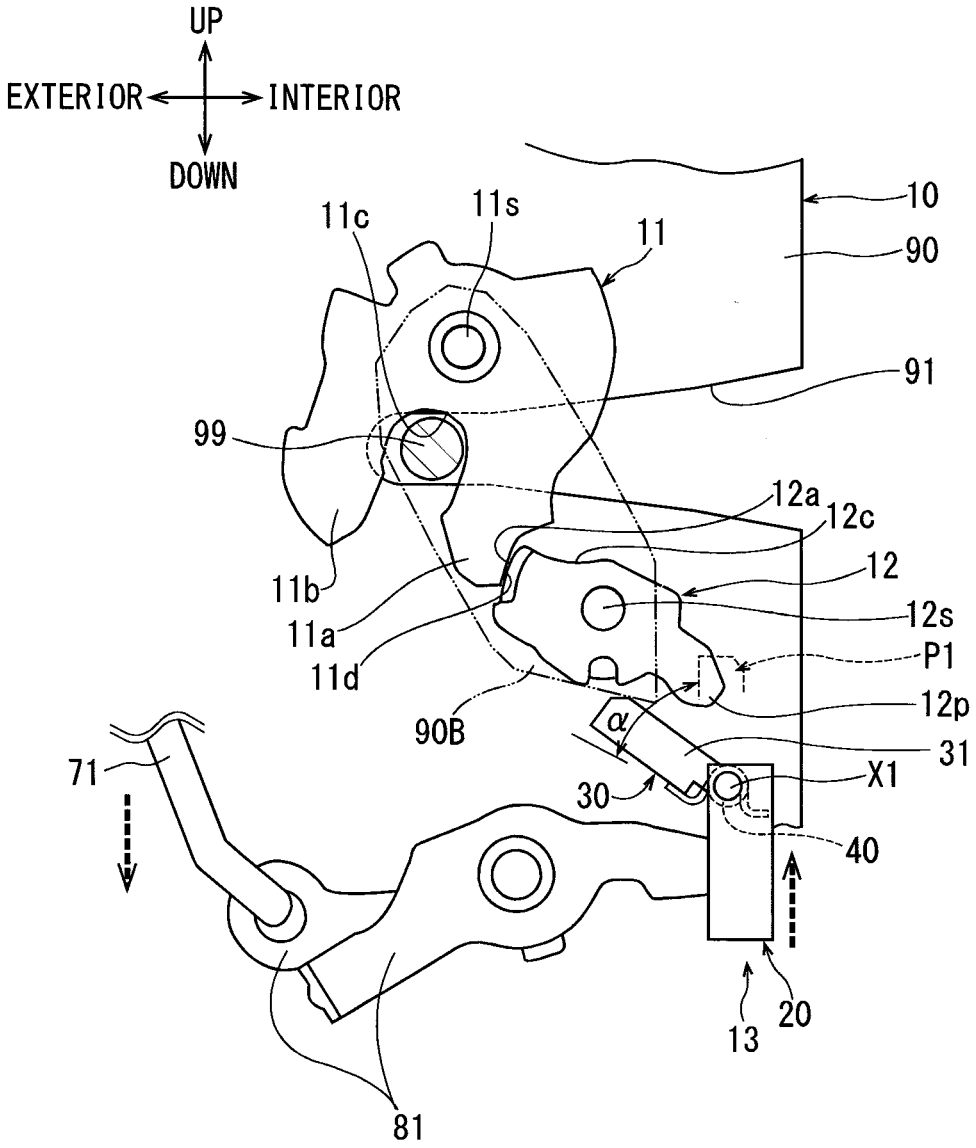
FIG. 11 is a schematic diagram of the vehicle door lock device in the embodiment, which explains movements of the lever main body and the inertial lever when the door and the vehicle body experience the impact from outside of the vehicle.

In addition, as shown in FIG. 11, if the rod 71 is displaced downward by the impact F0, a problem arises in that the lever main body 20 will move in an unintended manner. In the door lock device 1, however, the inertial lever 30 is displaced along a lower inclined surface of the back plate 90B while pivoting toward the exterior side of the vehicle body due to the inertial force F1 and is not displaced integrally with the lever main body 20. Thus, because the inertial lever 30 will avoid pressing the pawl 12, the so-called "swing-and-miss state", in which the fork 11 is not switched from the locked state to the released state, is achieved. Therefore, the door 2 does not open unintentionally and the safety of the occupants is ensured.

<Operational Effects>

With the door lock device 1 in the embodiment, the inertial lever 30 moves integrally with the lever main body 20 but is maintained in the initial position P1 due to the biasing force of the torsion coil spring 40 in the normal state. Therefore, as shown in FIGS. 8 and 9, if the lever main body 20 is displaced by the opening operation of the door 2 in the normal state, the inertial lever 30 presses the pawl 12 and the fork 11 is switched from the locking state to the released state.

In the door lock device 1, when an inertial force F1 greater than a pre-determined value acts on the mass body 31, the inertial lever 30 pivots about the pivot X1 relative to the lever main body 20 from the initial position P1 toward the exterior side of the vehicle body. Therefore, even if the lever main body 20 is displaced unintentionally, the inertial lever 30 will not move integrally with the lever main body 20 and will not press the pawl 12. Therefore, because the fork 11 is in the "swing-and-miss state", the door 2 is prevented from opening unintentionally and the safety of the occupants is ensured.

Furthermore, the door lock device 1 is configured such that when the inertial lever 30 pivots from the initial position P1 due to the inertial force F1, the pivot angle $\alpha$ is not limited by the lever main body 20. In other words, unlike the prior art, the lever main body 20 is not provided with an engagement hole and the pivot angle $\alpha$ of the inertial lever 30 is not limited by the engagement hole. Moreover, in the door lock device 1, because the biasing member is the torsion coil spring 40, which is provided coaxially with the pivot X1 between the lever main body 20 and the inertial lever 30, the pivot angle $\alpha$ of the inertial lever 30 is less likely to be limited by the torsion coil spring 40 as compared to the above-described prior art. As a result, it is possible to easily increase the pivot angle $\alpha$ of the inertial lever 30 in the door lock device 1. Therefore, even if an excessively large impact F0 is experienced, the inertial lever 30 can adapt to the impact F0 and can pivot to a sufficient angle. As a result, as compared to the above-described prior art, the problem, in which the inertial lever 30 that pivots due to the impact cannot sufficiently pivot and bounces back, is less likely to occur. Therefore, the door lock device 1 can reliably achieve the "swing-and-miss state".

Consequently, the door lock device 1 in the embodiment can reliably prevent the door 2 from opening due to the impact and can achieve higher occupant safety. As a result, it is possible to simplify or omit a reinforcing member that suppresses deformation of the door 2 in a collision as well as a collision door-opening prevention member, such as a counter weight of the exterior door handle 8; therefore, the manufacturing cost of the vehicle can be reduced.

Moreover, because the biasing member is the torsion coil spring 40 that is provided coaxially with the pivot X1, the door lock device 1 is easy to miniaturize and exhibits excellent mountability on the vehicle.

Furthermore, in the door lock device 1, the lever main body 20 is made of resin and the inertial lever 30 is made of metal. Therefore, the weight of the lever main body 20 can be reduced. Moreover, it is possible to provide mass to the inertial lever 30 while miniaturizing it. As a result, further miniaturization and weight savings of the door lock device 1 can be realized and thereby its excellent mountability on the vehicle can be further enhanced. In particular, because the inertial lever 30 is a zinc alloy die-cast in the embodiment, it is possible to easily obtain a thick-walled inertial lever 30 having a large mass and high strength and it is also possible to reduce manufacturing costs.

Although the invention has been described above in line with the embodiment, it is needless to say that the invention is not restricted to the above-described embodiment, but may be appropriately modified in application without departing from the gist of the invention.

INDUSTRIAL APPLICABILITY

The present invention can be applied to a vehicle, such as an automobile, a bus and an industrial vehicle.

EXPLANATION OF THE REFERENCE NUMBERS

2 . . . door
99 . . . striker
91 . . . entry opening
90 . . . mounting member
11 . . . fork
12 . . . pawl
13 . . . switching lever
1 . . . vehicle door lock device
8 . . . exterior door handle
20 . . . lever main body
X1 . . . pivot extending in a direction orthogonal to the vehicle width direction
P1 . . . initial position
30 . . . inertial lever
40 . . . biasing member (torsion coil spring)
31 . . . mass body
F1 . . . inertial force
$\alpha$ . . . pivot angle

The invention claimed is:

1. A vehicle door lock device, comprising:

a mounting member configured to be mounted on a door that opens and closes in a vehicle width direction relative to a vehicle body and formed with an entry opening, into which a striker fixed to the vehicle body is insertable;

a fork pivotably provided on the mounting member and configured to be switchable between a locked state, in which the striker would be locked within the entry opening, and a released state, in which locking of the striker within the entry opening is released;

a pawl pivotably provided on the mounting member and configured to selectively fix and allow pivoting of the fork; and a switching lever configured to press the pawl and to switch the fork from the locking state to the released state, wherein the switching lever includes a lever main body configured to be displaced by an opening operation of at least one of an exterior door handle and an interior door handle, an inertial lever provided on the lever main body so as to be pivotable from its initial position toward one side or the other about a pivot extending in a direction orthogonal to the vehicle width direction and which is configured to press the pawl if the inertial lever is disposed in its initial position and is displaced integrally with the lever main body, and a biasing member configured to apply a biasing force that urges the inertial lever towards its initial position, wherein the biasing member is a torsion coil spring provided coaxially with the pivot between the lever main body and the inertial lever, and the inertial lever has a mass body, wherein the biasing member and the mass body are configured such that if an inertial force greater than a predetermined value acts on the mass body, the inertial lever pivots from the initial position about the pivot relative to the lever main body and avoids pressing the pawl, and wherein the inertial lever is configured such that when the inertial lever pivots from the initial position due to the inertial force, its pivot angle is not limited by the lever main body.

2. The vehicle door lock device according to claim 1, wherein the lever main body is made of resin and the inertial lever is made of metal.

3. The vehicle door lock device according to claim 2, wherein the inertial lever is die-cast.

4. A vehicle door lock device, comprising:

a mounting member configured to be mounted on a vehicle door that opens and closes in a vehicle width direction relative to a vehicle body, the mounting member having an entry opening configured to receive a striker fixed to the vehicle body;

a fork pivotably disposed on the mounting member and configured to be switchable between a locked state, in which the striker would be locked within the entry opening, and an unlocked state, in which the striker would be free to be withdrawn from the entry opening;

a pawl pivotably disposed on the mounting member and configured to selectively cause the fork to pivot; and a switching lever configured to selectively press the pawl and to switch the fork from the locked state to the unlocked state, the switching lever including:

a lever main body configured to be displaced by an opening operation of at least one of an exterior door handle and an interior door handle, an inertial lever having a mass body pivotably disposed on the lever main body, the inertial lever being pivotable from an initial position about a pivot extending in a direction orthogonal to the vehicle width direction, and being configured to press the pawl so as to cause the fork to pivot and switch from the locked state to the unlocked state when the inertial lever is disposed in its initial position and is displaced together with the lever main body, and a torsion coil spring configured to urge the inertial lever towards its initial position, the torsion coil spring being disposed coaxially with the pivot between the lever main body and the inertial lever, wherein the torsion coil spring and the mass body are configured such that, when an inertial force greater than a pre-determined value acts on the mass body, the inertial lever will pivot in a direction opposite of the internal force from its initial position about the pivot relative to the lever main body against a biasing force of the torsion coil spring so as to avoid pressing the pawl and thereby causing the fork to remain in the locked state, and the inertial lever is configured such that its pivot angle is not limited by the lever main body when the inertial lever pivots away from its initial position due to the inertial force.

5. The vehicle door lock device according to claim 4, wherein the lever main body is made of resin and the inertial lever is made of metal.

6. The vehicle door lock device according to claim 5, wherein the inertial lever comprises a die-cast zinc alloy.

7. The vehicle door lock device according to claim 6, wherein the internal lever is pivotable about the pivot from its initial position towards an exterior side of the vehicle door by a pivot angle greater than or equal to 45°.

8. The vehicle door lock device according to claim 7, wherein the lever main body is configured to restrict the internal lever so that the internal lever does not pivot towards an interior side of the vehicle door farther than its initial position.

9. The vehicle door lock device according to claim 4, wherein the inertial lever comprises a die-cast zinc alloy.

10. The vehicle door lock device according to claim 4, wherein the internal lever is pivotable about the pivot from its initial position towards an exterior side of the vehicle door by a pivot angle greater than or equal to 45°.

11. The vehicle door lock device according to claim 4, wherein the lever main body is configured to restrict the internal lever so that the internal lever does not pivot towards an interior side of the vehicle door farther than its initial position.

12. A vehicle door comprising:

a door body, a key cylinder having a key insertion hole and mounted on the door body such that the key insertion hole is exposed on an exterior surface of the door body, the vehicle door lock device according to claim 4, wherein the mounting member is mounted on a door body and the key cylinder is mechanically coupled to the switching lever.

13. A vehicle door comprising:

a door body, a key cylinder having a key insertion hole and mounted on the door body such that the key insertion hole is exposed on an exterior surface of the door body, the vehicle door lock device according to claim 8, wherein the mounting member is mounted on a door body and the key cylinder is mechanically coupled to the switching lever.

14. The vehicle door lock device according to claim 1, wherein the inertial lever is configured to press directly on the pawl.

15. The vehicle door lock device according to claim 4, wherein the inertial lever is configured to press directly on the pawl.

16. The vehicle door lock device according to claim 1, wherein the pivot projects from the lever main body.

17. The vehicle door lock device according to claim 4, wherein the pivot projects from the lever main body.

18. A vehicle door lock device, comprising:

a mounting member configured to be mounted on a vehicle door that opens and closes in a vehicle width direction relative to a vehicle body, the mounting member having an entry opening configured to receive a striker fixed to the vehicle body;

a fork pivotably disposed on the mounting member and configured to be switchable between a locked state, in which the striker would be locked within the entry opening, and an unlocked state, in which the striker would be free to be withdrawn from the entry opening;

a pawl pivotably disposed on the mounting member and configured to selectively cause the fork to pivot; and a switching lever shiftable between a rest position and a release position by an opening operation of at least one of an exterior door handle and an interior door handle, the switching lever including:

a lever main body having a pivot, an inertial lever having a mass body pivotable about the pivot, the inertial lever being pivotable from an initial position to a second position angularly displaced about the pivot from the initial position, wherein shifting the switching lever from the rest position to the release position when the inertial lever is in the initial position causes the pawl to move in unison with the inertial lever so as to cause the fork to pivot and switch from the locked state to the unlocked state and wherein shifting the switching lever from the rest position to the release position when the inertial lever is in the second position causes the inertial lever to move independently of the pawl, and a torsion coil spring configured to urge the inertial lever towards the initial position, the torsion coil spring being disposed coaxially with the pivot between the lever main body and the inertial lever, wherein the torsion coil spring and the mass body are configured such that, when an inertial force greater than a pre-determined value acts on the mass body, the inertial lever will pivot to the second position against a biasing force of the torsion coil spring.

19. The vehicle door lock device according to claim 18, wherein the inertial lever is configured to press directly on the pawl when the inertial lever is in the initial position and the switching lever is shifted from the rest position to the release position.

* * * * *